US005157218A

United States Patent [19]

Kunimoto et al.

[11] Patent Number: 5,157,218

[45] Date of Patent: Oct. 20, 1992

[54] MUSICAL TONE SIGNAL FORMING APPARATUS

[75] Inventors: Toshifumi Kunimoto; Akira Yamauchi, both of Hamamatsu, Japan

[73] Assignee: Yamaha Corporation, Hamamatsu, Japan

[21] Appl. No.: 557,963

[22] Filed: Jul. 26, 1990

[30] Foreign Application Priority Data

Jul. 27, 1989 [JP] Japan ..... 1-192708
Jul. 27, 1989 [JP] Japan ..... 1-194544

[51] Int. Cl.[5] ..... G10H 1/14; G10H 5/02
[52] U.S. Cl. ..... 84/659; 84/661
[58] Field of Search ..... 84/659-661, 84/670

[56] References Cited

U.S. PATENT DOCUMENTS 4,475,229 10/1984 Frese ..... 381/63
4,736,663 4/1988 Wawrzynek et al. ..... 84/DIG. 9
4,882,965 11/1989 McClish ..... 84/453
4,984,276 1/1991 Smith ..... 84/630 X

FOREIGN PATENT DOCUMENTS 0248527 4/1987 European Pat. Off. .
63-40199 2/1988 Japan .

*Primary Examiner*—William M. Shoop, Jr.
*Assistant Examiner*—Brian Sircus
*Attorney, Agent, or Firm*—Graham & James

[57] ABSTRACT

An electronic musical instrument provides a musical tone signal forming apparatus in order to sound a desirable musical tone. This apparatus includes a closed-loop wherein a signal is repeatedly circulating while being delayed by a delay circuit. In addition, the signal circulating the closed-loop is subject to the non-linear conversion. Thus, the signal picked up from the closed-loop can be controlled in response to the desirable non-linear characteristic. Preferably, the signal circulating the closed-loop is a musical tone waveform signal. For example, the musical tone waveform signal is varied in response to the feature of string, string bowing pressure and the like. Further, hysteresis characteristic simulating the statical and dynamic frictions to be occurred between the string and bow of the string bowing instrument can be imported to the non-linear characteristic.

9 Claims, 4 Drawing Sheets

MUSICAL TONE SIGNAL FORMING APPARATUS

BACKGROUND OF THE INVENTION

1. Field of the Invention

The present invention relates to an electronic musical instrument employing a musical tone signal forming apparatus which can be utilized for the music education system, music toys and the like.

2. Proir Art

Japanese Patent Laid-Open Publiclation No. 63-40199 discloses the conventional apparatus providing a non-linear conversion circuit within a signal circulating loop including a signal delay circuit. Herein, a waveform signal is circulating in the signal circulating loop, and the non-linear conversion circuit convolutes a start control signal from an exteranl device with the waveform signal. Thus, in response to the start control signal, this apparatus starts to form the waveform signal. Then, by repeatedly circulating the waveform signal through the signal circulating loop, the desirable musical tone waveform signal is to be formed.

The above-mentioned apparatus is suitable for simulating the wind instrument which generates the sounds by the reflecting and transmitting the air-flow which is blown into a resonance tube via a mouth-piece. However, the above-mentioned apparatus is not suitable for simulating the string bowing instrument such as the violin and viola to be played by bowing the strings.

Meanwhile, Japanese Patent Laid-Open Publication No. 63-40199 discloses a wave-guide type signal processor which carries out the operation process on waveform data inputted in the closed-loop including the delay circuit to thereby synthesize the musical tone or impart the special sound effect such as the reverberation to the musical tone.

This signal processor physically simulates the mechanical vibration system of the non-electronic instrument, such as the resonance tube of wind instrument and strings of stringed instrument, by use of the electric circuit. Therefore, it is expected that by inputting the non-linear signal corresponding to the motion of the reed or Embousure of wind instrument or the relative motion between the bow and string of the string bowing instrument into the above-mentioned closed loop, the sounds of the wind instrument and string bowing instrument can be simulated naturally with high-fidelity.

However, in the conventional electronic musical instrument using the non-linear musical tone synthesizing appararus which inputs the non-linear signal into the above-mentioned signal processor, it is difficult to control the synthesized sound in response to several kinds of performance parameters without overlooking nuances in the performance expression made by the non-electronic musical instrument because of the following reason.

Conventionally, the non-linear musical tone synthesizing apparatus uses one or more fixed non-linear tables as the non-linear signal generating source. Even if plural non-linear tables are used, one of them is selected by certain control variable, wherein one table is designed to generate one non-linear signal. Therefore, the kinds of non-linear signals must be limited by the number of tables to be provided, so that the selection of the non-linear signal must be narrowed. In other words, the electronic musical instrument using such non-linear musical tone synthesizing apparatus is restricted in its expression. For this reason, it is difficult to control the synthesized sound in response to several kinds of performance parameters without overlooking nuances in the performance expression made by the non-electronic musical instrument.

SUMMARY OF THE INVENTION

It is accordingly a primary object of the present invention to provide a musical tone signal forming apparatus which is suitable for simulating the string bowing instrument.

In is another object of the present invention to provide a musical tone signal forming apparatus capable of synthesizing a plenty of musical tones by use of the limited number of non-linear functions.

In a first aspect of the present invention, there is provided a musical tone signal forming apparatus comprising:

(a) a loop in which a signal is repeatedly circulating;

(b) first and second delay means to be provided within the loop, each delaying the signal supplied thereto;

(c) mixing means for mixing a start control signal from an external device with each of outputs of the first and second delay means to thereby produce a mixed signal; and (d) non-linear converison means for effecting a non-linear conversion on the mixed signal to thereby produce a converted signal, which is outputted to each of the first and second delay means, whereby a synthesized musical tone signal is picked up from the loop.

In a second aspect of the present invention, there is provided a musical tone signal forming apparatus comprising:

(a) a closed-loop including delay means which delays a signal circulating therein; and (b) non-linear function means for generating a non-linear signal based on a performance operation signal and the signal picked up from the closed-loop, the non-linear signal being fed back to the closed-loop, wherein the non-linear function means has a hysteresis characteristic which is controlled by the performance operation signal.

In a third aspect of the present invention, there is provided a musical tone signal forming apparatus comprising:

(a) a closed-loop including delay means which delays a signal circulating therein;

(b) non-linear function means for generating a non-linear signal based on a performance operation signal and the signal picked up from the closed-loop, the non-linear signal beng fed back to the closed-loop; and (c) control means for generating a control signal corresponding to a musical tone parameter, wherein the non-linear function means employs a hysteresis characteristic which is controlled by the control signal.

BRIEF DESCRIPTION OF THE DRAWINGS

Further objects and advantages of the present invention will be apparent from the following description, reference being had to the accompanying drawings wherein preferred embodiments of the present invention are clearly shown.

In the drawings.

DESCRIPTION OF THE PREFERRED EMBODIMENTS

Figure 1:
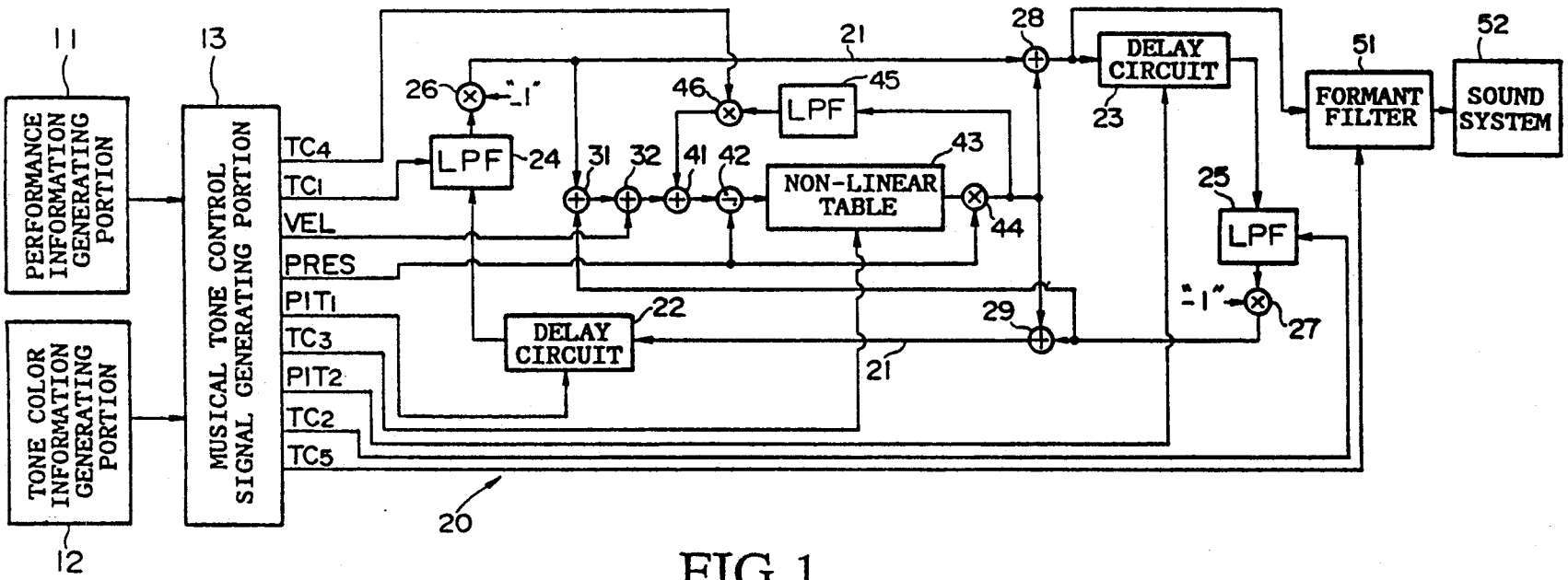
FIG. 1 is a block diagram showing the whole configuration of an elelctronic musical instrument providing a musical tone signal forming apparatus according to a first embodiment of the present invention.

Next, description will be given with respect to the preferred embodiments of the present invention by referring to the drawings, wherein like reference characters designate like or corresponding parts throughout the several views.

[A] FIRST EMBODIMENT

FIG. 1 is a bock diagram showing the whole configuration of the electronic musical instrument employing the musical tone signal forming apparatus according to the first embodiment of the present invention.

As shown in FIG. 1, this electronic musical instrument provides a performance information generating portion 11, a tone color information generating portion 12 and a musical tone control signal generating portion 13. Herein, based on performance information and tone color information, the musical tone control signal generating portion 13 generates a musical tone control signal. This musical tone control signal is supplied to a musical tone waveform signal forming portion 20, in which a musical tone waveform signal of the string bowing instrument such as the violin and viola is to be formed.

The performance information generating portion 11 contains a keyboard providing plural keys corresponding to the musical scale and several circuits (not shown) accompanied with the keyboard, such as a key-depression detecting circuit for detecting a key-depression event of each key, an initial-touch detecting circuit for detecting a key-depression speed of each key and an after-touch detecting circuit for detecting a key-depression or key-depressed depth. Thus, the performance information generating portion 11 generates and outputs the performance information such as key information indicating the key-depression event and depressed key; initial-touch information and after-touch information. The tone color information generating portion 12 provides tone color selecting switches and their operation detecting circuits (not shown), so that it generates the tone color information indicating the selected tone color. The musical tone control signal generating portion 13 is configured by a micro computer and a table for storing musical tone control parameters and the like (not shown). In response to the performance information and tone color information, the musical tone control signal generating portion 13 refers to the table to thereby generate first musical tone control signals which are not varied in a lapse of time and second musical tone control signals which are varied in a lapse of time. For example, these musical tone control signals include first and second pitch signals $PIT_1$, $PIT_2$ each indicating the pitch of the musical tone corresponding to the depressed key; a bowing velocity signal VEL indicating a bow moving velocity of the string bowing instrument which is determined based on the initial-touch information, after-touch information and tone color information; a bowing pressure signal PRES indicating the pressure which is applied to the string by the bow when moving the bow; and tone color control signals $TC_1$ to $TC_5$ each indicating the tone color which is determined mainly based on the tone color information but auxiliarily based on the performance information.

Incidentally, when the electronic musical instrument provides other performance controls such as a wheel and a pedal to be operated by the performer, it is possible to use information concerning the operations of such other performance controls as the performance information like the initial-touch information and after-touch information. In addition, it is possible to use other units such as other instruments, automatic performance apparatus and the like as the performance information generating portion 11 and tone color information generating portion 12. In this case, the musical tone control signal generating portion 13 receives the performance information and tone color information from the other units. Or, it is possible to omit the musical tone control signal generating portion 13, so that several kinds of musical tone control signals to be generated in the other units are directly supplied to the musical tone waveform signal forming portion 20.

Meanwhile, the musical tone waveform signal forming portion 20 provides a closed-loop, i.e., a signal circulating path 21 in which the musical tone waveform signal is circulating in response to the string of the string bowing instrument. In this loop, there are provided delay circuits 22, 23, low-pass filters (LPFs) 24, 25, multipliers 26, 27 and adders 28, 29 to be connected in series. Herein delay times of the delay circuits 22, 23 are respectively varied by the pitch signals $PIT_1$, $PIT_2$. In the present embodiment, the pitch of the musical tone to be generated is determined mainly based on the delay times of the delay circuits 22, 23 to be varied. By varying the transmission characteristic of the musical tone waveform signal circulating the closed-loop, each of the LPFs 24, 25 can simulate several kinds of vibration characteristics to be imparted to the string. The foregoing tone color control signals $TC_1$, $TC_2$ changes over the transmission characteristics of the LPFs 24, 25. The multipliers 26, 27 multiply the circulating waveform signal by the same coefficient "$-1$" to thereby shift its phase by the electric angle "$\pi$". Thus, these multipliers 26, 27 simulate the termination of the vibration wave to be occurred 29

The outputs of multipliers 26, 27 are supplied to an adder 31 wherein these outputs are added together. Then, the addition result of the adder 31 is supplied to another adder 32 wherein it is added to the bowing velocity signal VEL. These adders 31, 32 simulate the displacement in which the contact portion between the string and bow is moved in response to the movement of the bow and another displacement in which such contact portion is moved by the vibration wave propagating through the string.

Next, the output of adder 32 is supplied to a non-linear table 43 via an adder 41 and a divider 42, and then an output of non-linear table 43 is transmitted to the signal circulating paths 21. The non-linear table 43 effects the non-linear conversion on the output of adder 32 to thereby simulate the string displacement due to the movement of the bow. The input/output characteristic of the non-linear table 43 is set as shown by the solid line of FIG. 2. More specifically, when the string is bowed at low bowing velocity, the frictional force to be occurred between the string and bow is varied mainly depending on the static friction coefficient so that the string vibrating speed becomes roughly equal to the bowing velocity. In contrast, when the string is bowed at high bowing velocity, such frictional force is varied mainly depending on the dynamic friction coefficient so that the string vibrating speed becomes lower than the bowing velocity. The above-mentioned phenomenon is simulated by the non-linear conversion effected by the non-linear table 43. Incidentally, the non-linear characteristics of the non-linear table 43 are controlled by the tone color control signal $TC_3$.

Figure 2:
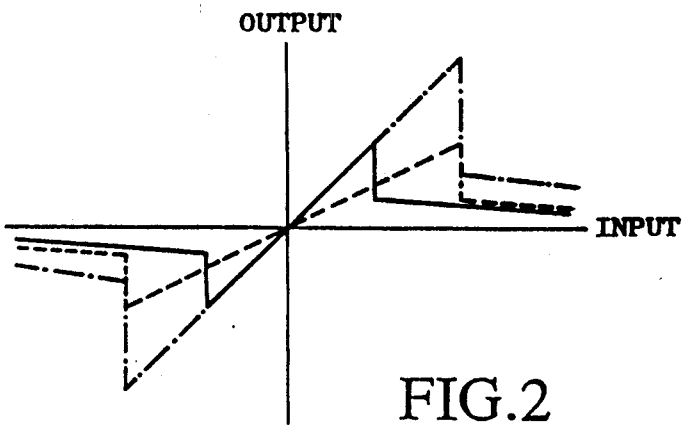
FIGS. 2 and 3 are graphs each showing the non-linear conversion characteristic used in the first embodiment.

Meanwhile, the bowing pressure signal PRES is supplied to the divider 42 and multiplier 44. Herein, the divider 42 divides the output of adder 41 by the bowing pressure signal PRES, so that the division result thereof is supplied to the non-linear table 43. On the other hand, the multiplier 44 multiplies the output of non-linear table 43 by the bowing pressure signal PRES. The above-mentioned divider 42 and multiplier 44 simulate the phenomenon in which the friction coefficient is varied due to the variatio of the bowing pressure so that the non-linear characteristic as shown by the solid line in FIG. 2 is varied. More specifically, by dividing the output of adder 41 by the bowing pressure signal PRES in the divider 42, the non-linear characteristic as shown by the slid line in FIG. 2 is changed to non-linear characteristic as shown by the dotted line in FIG. 2. Then, by multiplying the output of non-linear table 43 by the bowing pressure signal PRES in the multiplier 44, the non-linear characteristic as shown by the dotted line is changed to the non-linear characteristic as shown by the dashed line in FIG. 2. Thus, due to the above-mentioned operations of the divider 42 and multiplier 44, the I/O characteristic of the non-linear table 43 is controlled such that the string vibrating speed is magnified or reduced in response to the bowing pressure while maintaining the ratio between the string vibrating speed and bowing velocity constant.

The output of multiplier 44 is fed back to the adder 41 via the LPF 43 and multiplier 46. This feedback operation imparts the hysteresis characteristic to the non-linear conversion carried out by the non-linear table 43, divider 42 and multiplier 44.

Figure 3:
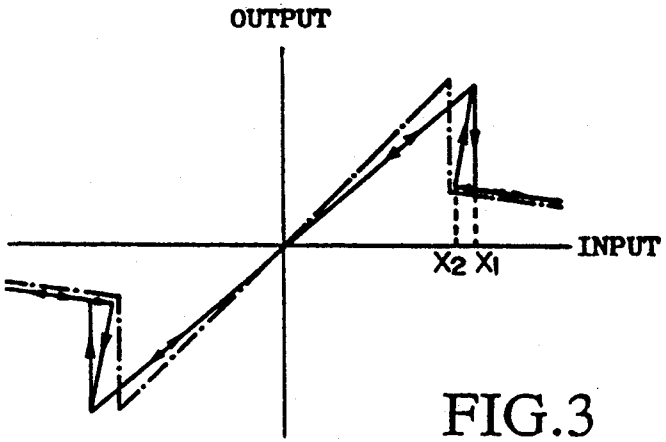

Next, detailed description will be given with respect to the above-mentioned hysteresis characteristic to be imparted to the non-linear conversion. Incidentally, the musical tone control signal generating portion 13 supplies the tone color control signal $TC_4$ to the multiplier 46, wherein $TC_4$ has a negative decimal value such as "−0.1", "−0.2". In this case, the adder 41 functions as the subtractor which subtracts the output of multiplier 46 from the output of adder 32. FIG. 3 is a graph for explaining the hysteresis characteristic, wherein the dashed line indicates the relationship between the outputs of the adder 41 and multiplier 46. For example, while the non-linear conversion input (i.e., output of adder 32) increases from zero level in positive direction, the non-linear conversion output (i.e., output of multiplier 44) increases proportionally along with the solid line shown in FIG. 3. In the vicinity of input values $X_1$, $X_2$, the non-linear conversion output is at the maximum positive value, which increases the output of multiplier 46 to be subtracted from the output of adder 32 in the subtractor 41. When the non-linear conversion input reaches the value $X_1$, the non-linear conversion output rapidly decreases. Then, as the input value increases, the output value further decreases. Thereafter, when the non-linear conversion input decreases, the output of multiplier 46 decreases because the non-linear conversion output is relatively small. Therefore, even if the non-linear conversion input is at the same value, the output of subtractor 41 to be supplied to the divider 42 is relatively large when decreasing the non-linear conversion input. When the non-linear conversion input is further decreased so that it reaches the input value $X_2$ which is smaller than $X_1$, the non-linear conversion output rapidly increases. In the case where the non-linear conversion input is varied in the field of the negative value, the similar operation as described above is to be made. Due to such operation, the hysteresis characteristic can be imparted to the non-linear conversion.

Meanwhile, the LPF 45 functions to avoid the oscillation of this closed-loop, while the multiplier 46 functions to adjust the feedback gain. Thus, the hysteresis characteristic (i.e., width of the hysteresis loop) is varied in response to the tone color control signal $TC_4$ supplied to the multiplier 46. Incidentally, it is possible to vary the characteristic of the LPF 45 in response to the tone color control signal.

Further, the output of adder 28 (i.e., input of delay circuit 23) is supplied to a formant filter 51. This formant filter 51 is provided to simulate the acoustic characteristic of the body of the string bowing instrument. More specifically, the frequency characteristic of the formant filter 51 is changed over by the tone control signal $TC_5$, and then such frequency characteristic is imparted to the output of adder 28. Thereafter, the output of formant filter 51 is supplied to a sound system 52, which is configured by an analog-to-digital converter, an amplifier, a speaker and the like (not shown). This sound system 52 is designed to convert the input signal thereof to the acoustic signal, of which sound is to be generated.

Next, description will be given with respect to the operation of the present embodiment as shown in FIG. 1.

First, the performance information generating portion 11 outputs the performance information representative of the key information, initial-touch information, after-touch information and the like. When the musical tone control signal generating portion 13 receives such performance information, it generates and then outputs several kinds of musical tone control signals to the musical tone waveform signal forming portion 20 based on the performance information and the tone color information outputted from the tone color information generating portion 12.

In the musical tone waveform signal forming portion 20, the adder 32 inputs the bowing velocity signal VEL, which is then outputted to the non-linear table 43 via the adder 41 and divider 42. Then, the non-linear table 43 converts the bowing velocity signal VEL into the non-linear signal, which is supplied to the adders 28, 29 via the multiplier 44 as the foregoing non-linear conversion output. The adders 28, 29 output the input signals thereof to the signal circulating path 21. The outputs of the adders 28, 29 are transmitted onto the signal circulating path 21 and circulating through the delay circuits 22, 23, LPF 24, 25, multipliers 26, 27 and adders 28, 29 sequentially. In the present embodiment, the delay times of the delay circuits 22, 23 are controlled by the pitch signals $PIT_1$, $PIT_2$ respectively outputted from the musical tone control signal generating portion 13. Thus, the sum of these delay times is controlled to be set corresponding to the pitch period of the depressed key in the keyboard. In other words, the time required to circulate the closed-loop once becomes equal to the pitch period of the depressed key. In short, such circulating signal will indicate the waveform signal having the pitch period of the depressed key. While such waveform signal is circulating through the closed-loop, the frequency characteristic corresponding to the string vibrating characteristic is imparted to the waveform signal by controlling the LPFs 24, 25 with the tone color control signals $TC_1$, $TC_2$. In addition, the multipliers 26, 27 shift the phase of the waveform signal by "$\pi$" in order to simulate the termination of the string vibration at both edges of the string of the string bowing instrument. Thus, the waveform signal circulating the closed-loop can simulate the vibration wave transmitted through the string well.

Such circulating waveform signal is picked up and then supplied to the formant filter 51 in which frequency characteristic simulating the acoustic characteristic of the body of the string bowing instrument is imparted to the waveform signal under control of the tone color control signal $TC_5$. Then, the output of formant filter 51 is supplied to the sound system 52 wherein it is converted into the acoustic signal, of which sound is to be generated. Thus, the musical tone to be generated from the sound system 52 has the waveform extremely close to that of the sound generated from the body of the string bowing instrument of which string is vibrated by being bowed.

Meanwhile, the bowing velocity signal VEL is continuously supplied to the adder 32, to which the waveform signal circulating the closed-loop is also supplied via the adder 31. Therefore, the addition result of adder 32 (i.e., mixed signal of the bowing velocity signal VEL and waveform signal) is to be supplied to the non-linear table 43. As described before, the non-linear table 43 effects the non-linear conversion on the addition result of adder 32. In addition, the divider 42 and multiplier 44 are controlled by the bowing pressure signal PRES outputted from the musical tone control signal generating portion 13, so that the scale of the non-linear conversion characteristic is magnified or reduced in response to the bowing pressure signal PRES (see FIG. 2). Further, the feedback loop including the LPF 45 and multiplier 46 is controlled by the tone color control signal $TC_4$ outputted from the musical tone control signal generating portion 13, so that the hysteresis characteristic is imparted to the non-linear conversion characteristic in response to the tone color control signal $TC_4$ (see FIG. 3). Therefore, the present embodiment can simulate the relationship between the string and bow of the string bowing instrument in which the friction coefficient is varied in response to the bowing velocity. Thus, the musical tone generated from the sound system 52 will have the waveform extremely close to that of the sound actually generated from the string bowing instrument.

In the present embodiment described above, the I/O characteristic of the non-linear conversion is magnified or reduced by use of the divider 42 and multiplier 44. Instead of the divider 42 and multiplier 44, it is possible to provide a plurality of non-linear tables each corresponding to the magnified or reduced I/O characteristic of the non-linear conversion. In this case, the non-linear tables are selectively changed over in response to the bowing pressure signal PRES. In addition, the non-linear table 43 effects the non-linear conversion on the bowing velocity signal VEL and circulating waveform signal in the present embodiment. Instead of the non-linear table 43, it is possible to use non-linear operations by which the non-linear conversion is carried out.

In the present embodiment, the output terminal at which the circulating waveform signal is picked up is formed between the adder 28 and delay circuit 23. However, it is possible to form such output terminal at any position on the signal circulating path.

[B] SECOND EMBODIMENT

Figure 4:
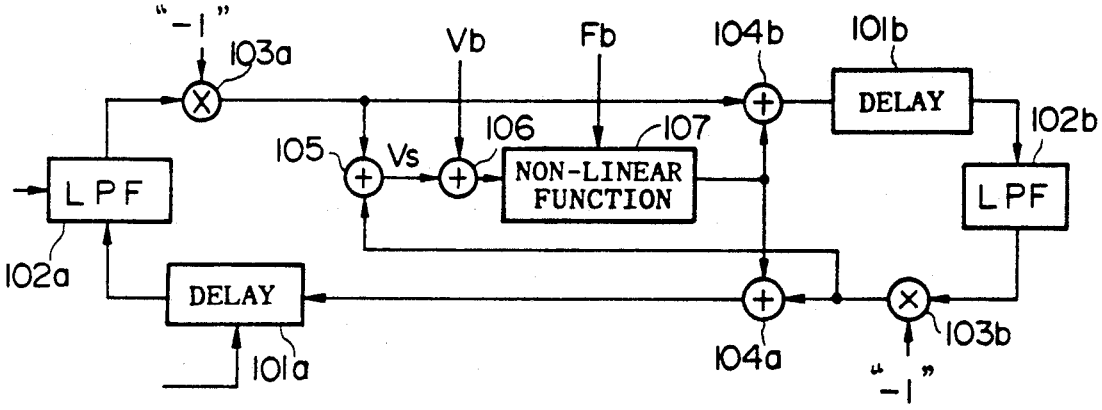
FIG. 4 is a block diagram showing an electric configuration of a musical tone synthesizing portion of an electronic musical instrument according to a second embodiment of the present invention.

Next, description will be given with respect to the second embodiment of the present invention, wherein FIG. 4 shows a part of the musical tone synthesizing portion of the electronic musical instrument.

The second embodiment is characterized by synthesizing the performed tones of the string bowing instrument such as the violin by use of the digital data operational process. Herein, the circuit portion shown in FIG. 4 provides delay circuits 101*a*, 101*b*, LPFs 102*a*, 102*b*, multipliers 103*a*, 103*b*, adders 104*a*, 104*b*, 105, 106 and a non-linear function generating unit 107.

The closed-loop including the delay circuits 101*a*, 101*b*, LPFs 102*a*, 102*b*, multipliers 103*a*, 103*b* and adders 104*a*, 104*b* corresponds to the string to be bowed. Herein, the total delay time of this closed-loop corresponds to the resonance frequency of the string.

In addition, the delay times of the delay circuits 101*a*, 101*b* and transmission characteristics of the LPFs 102*a*, 102*b* are controlled based on the performance information by the control circuit (not shown).

The multipliers 103*a*, 103*b* multiplies input signals thereof by the same coefficient "−1", so that they function as the phase inverters. Incidentally, these multipliers can be used as the attenuators by setting the absolute value of multiplication coefficient thereof lower than "1".

Further, the adders 104*a*, 104*b* corresponds to the string bowing point at which the bow is in contact with the string. With respect to this point, the closed-loop is divided into the first signal path including the adder 104*a*, delay circuit 101*a*, LPF 102*a* and multiplier 103*a* and second signal path including the adder 104*b*, delay circuit 101*b*, LPF 102*b* and multiplier 103*b*.

The adder 105 adds the outputs of the above-mentioned first and second signal paths together. Then, the addition result of adder 105 is further added to a signal Vb indicating the bowing velocity in the adder 106, of which addition result is supplied to the non-linear function generating unit 107. In response to the instantaneous value of the output of adder 106, the non-linear function generating unit 107 generates a non-linear function having the I/O characteristic as shown in FIG. 5.

The function signal outputted from the non-linear function generating unit 107 is supplied to the adders 104*a*, 104*b*, from which it is further transmitted to the foregoing first and second signal paths.

Figure 5:
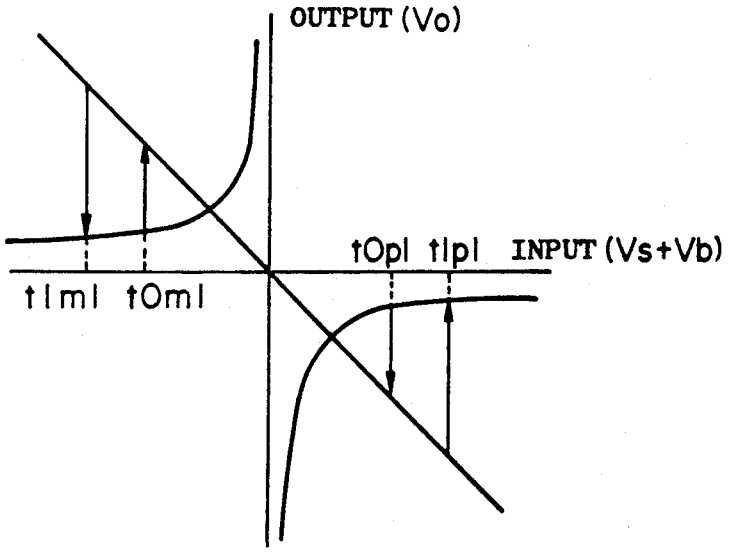
FIG. 5 is a graph showing the I/O characteristic of the non-linear function used in the second embodiment.

The I/O characteristic as shown in FIG. 5 indicates the friction characteristic representative of the friction to be occurred between the string and bow. In other words, this I/O characteristic incorporates the non-linear characteristic and hysteresis characteristic to be occurred when the statical frictional state is changed to the dynamic frictional state. Since the statical friction becomes large as the bowing pressure becomes large, the hysteresis characteristic is varied by bowing pressure Fb.

As described above, the apparatus as shown in FIG. 4 indicates a physical model which electrically simulates the mechanical vibration system of the strings of the string bowing instrument and the drive system operated by the string and bow. By raising the simulation precision, it is possible to reproduce the sound of string bowing instrument with high fidelity.

(1) Non-Linear Function Generating Unit

Next, detailed description will be given with respect to the non-linear function generating unit 107 by referring to FIGS. 6 to 8.

Figure 6:
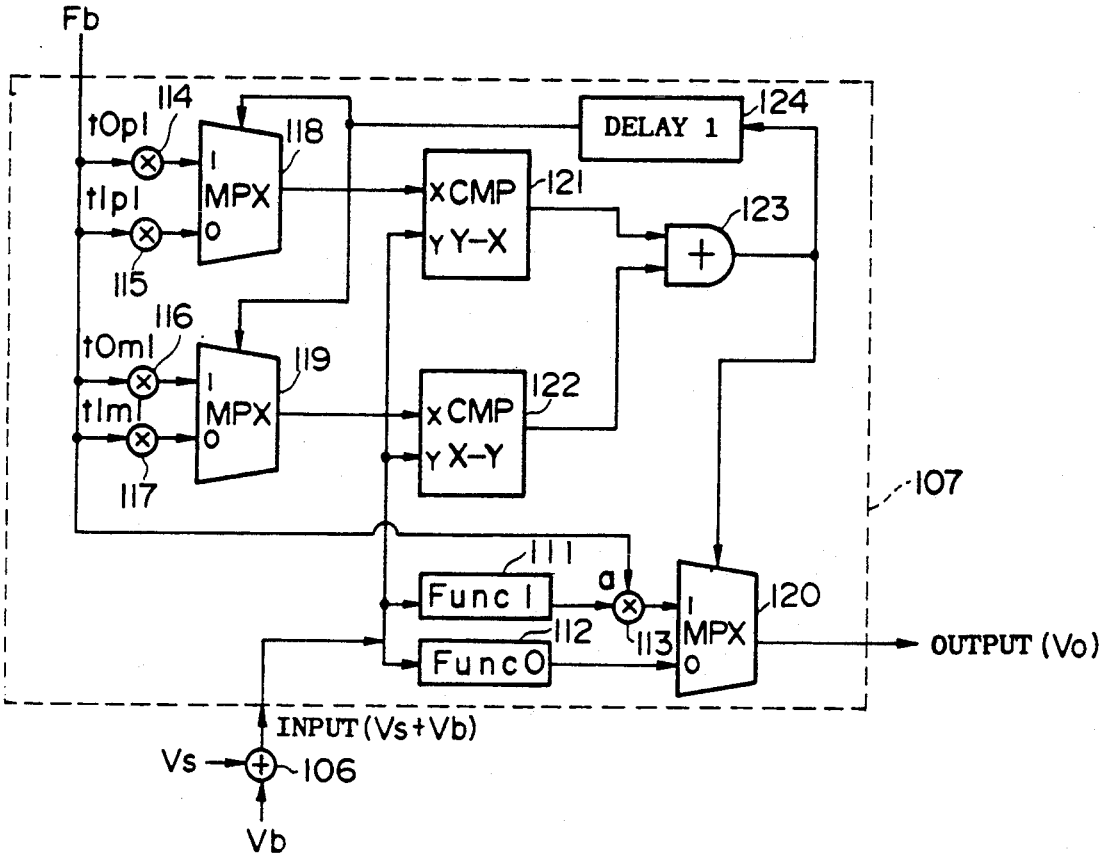
FIG. 6 is block diagram showing a non-linear function generating portion of electronic musical instrument.

This unit 107 shown in FIG. 6 is used to generate the non-linear function having the hysteresis characteristic, wherein it provides function tables 111, 112, multipliers 113 to 117, selectors (or multiplexers) 118 to 120, comparators 121, 122, an OR circuit 123 and a delay circuit 124.

Herein, Vs indicates the sum of the outputs of first and second signal paths, while Vb indicates the bowing velocity. The adder 106 adds these data Vs, Vb together to thereby generate addition result (Vs+Vb). When inputting such data (Vs+Vb) as the address, the function table 111 generates the hyperbolic function as shown in FIG. 7. This hyperbolic function indicates the dynamic friction characteristic to be occurred between the string and bow.

Figure 8:
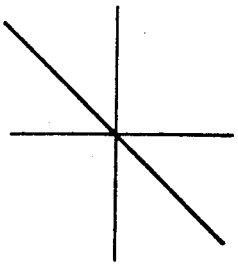

On the other hand, when inputting the data (Vs+Vb), the function table 112 the linear function as shown in FIG. 8. This linear function indicates the statical friction characteristic.

The multiplier 113 multiplies the output of function table 111 by the bowing pressure Fb, by which the hyperbolic function is biased in response to the bowing pressure Fb.

The multipliers 114 to 117 multiply the bowing pressure Fb by constants t0p1, t1p1, t0m1 respectively to thereby produce threshold values corresponding to Fb (hereinafter, these threshold values will be respectively indicates by t0p1, t1p1, t0m1, t1m1). Herein, the constants t0p1, t1p1 are positive values, while other constants t0m1, t1m1 are negative values.

Meanwhile, the selector 118 selects one of the threshold values t0p1, t1p1. Then, the comparator 121 compares the selected threshold value to the input data (Vs+Vb). When the input data is larger than the absolute value of the threshold value, the comparator 121 outputs "1" signal. On the other hand, when the input data is smaller than the threshold value, the comparator 121 outputs "0" signal.

Similarly, the selector 119 selects one of the threshold values t0m1, t1m1. Then, the comparator 122 compares the selected threshold value to the input data (Vs+Vb). When the input data is larger than the absolute value of the threshold value, the comparator 122 outputs "0" signal. On the other hand, when the input data is smaller than the threshold value, the comparator 122 outputs "1" signal.

Next, the OR circuit 123 carries out the OR operation on the outputs of comparators 121, 122. The output of OR circuit 123 is supplied to both of the delay circuit 124 and selector 120.

The delay circuit 124 slightly delays the output of OR circuit 123 to thereby supply the delayed output thereof to both of the selectors 118, 119 as select signals.

Next, description will be given with respect to the operation of the non-linear function generating unit 107 by referring to FIGS. 5, 7, 8.

First, when the input data (Vs+Vb) is at "0", both of the outputs of comparators 121, 122 are at "0" so that the output of OR circuit 123 is at "0". In addition, the output of delay circuit 124 is also at "0", which will be described later. Therefore, the selector 118 selectively outputs the threshold value t1p1 to the comparator 121, while the selector 119 selectively outputs the threshold value t1m1 to the comparator 122. In addition, the selector 120 selects the output of function table 112 (see FIG. 8). Thereafter, when the input data (Vs+Vb) further increases so that it exceeds the threshold value t1p1, the output of comparator 118 turns to "1" and consequently the output of OR circuit 123 turns to "1". In response to such "1" signal outputted from the OR circuit 123, the selector 120 selects the hyperbolic function outputted from the function table 111 (see FIG. 7). Thus, as shown in FIG. 5, the output data Vo of the selector 120 increases linearly from zero level along with the linear line while the input data (Vs+Vb) increases. Then, when the input data exceeds the threshold value t1p1, the linear function is changed over to the hyperbolic function, so that the output data Vo is suddenly lowered. Thereafter, as the input data further increases, the output data decreases along with the hyperbolic curve. At this time, the output of delay circuit 124 is at "1" level so that the selector 118 selectively outputs the threshold value t0p1 to the comparator 121.

Thereafter, the input data decreases, the output data increases along with the hyperbolic curve. Then, when the input data is lowered and reached the threshold value t0p1, the output of comparator 121 turns to "0" so that the output of OR circuit 123 also turns to "0". Consequently, the selector 120 selects the output of function table 111 (see FIG. 7), so that the output data Vo increases un-continuously (or non-linearly) as shown in FIG. 5. Thereafter, as the input data (Vs+Vb) further decreases, the output data Vo decreases along with the linear curve shown in FIG. 7. At this time, the output of delay circuit 124 is at "0" as described before. Therefore, the selectors 118, 119 select the threshold values t1p1, t1m1 respectively. Thus, as long as the input data (Vs+Vb) increases or decreased within the range between these threshold values t1p1, t1m1, the output data Vo varies in response to the linear function as shown in FIG. 7.

Meanwhile, when the input data has the negative value, a pair of the selector 119 and comparator 122 operates as similar to another pair of the selector 118 and comparator 121. More specifically, when the input data becomes lower than the threshold value t1m1, the linear function shown in FIG. 7 is changed over to the hyperbolic function shown in FIG. 8 under operation of the comparator 122, and consequently the output data Vo is varied along with the hyperbolic curve. Thereafter, when the input data increases so that it reaches the threshold value t0m1, the hyperbolic function is changed over to the linear function so that the output data Vo is varied along with the linear curve.

Figure 7:
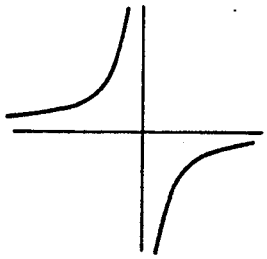
FIGS. 7 and 8 are graphs each showing the non-linear function to be generated from the circuit shown in FIG. 6.

As described above, the non-linear function generating unit 107 shown in FIG. 6 uses two kinds of functions, i.e., the hyperbolic function shown in FIG. 7 and linear function shown in FIG. 8. When the input data becomes lower than the threshold value t1m1 or becomes higher than the threshold value t1p1 while this unit 107 refers to the hyperbolic function shown in FIG. 7, such hyperbolic function is changed over to the linear function shown in FIG. 8. In contrast, when the input data becomes higher than the threshold value t0m1 or becomes lower than the threshold value t0p1 while this unit 107 refers to the linear function shown in FIG. 8, such linear function is changed over to the hyperbolic function shown in FIG. 7. Thus, it is possible to generate the non-linear function having the hysteresis characteristic as shown in FIG. 5.

(2) Modified Example of Non-Linear Function Generating Unit

Next, description will be given with respect to a modified example of the non-linear function generating unit 107 by referring to FIG. 9.

Figure 9:
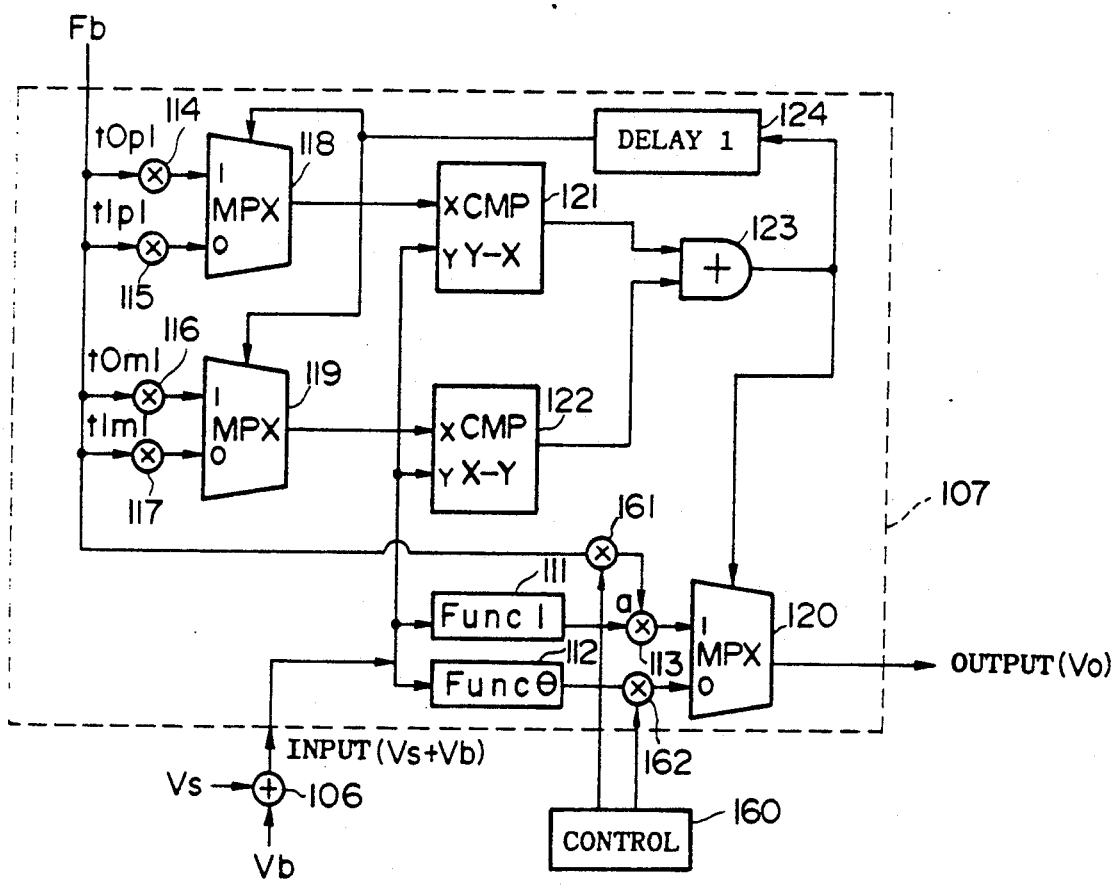
FIG. 9 is a block diagram showing a modified example of the non-linear function generating portion of electronic musical instrument.

This unit 107 shown in FIG. 9 is designed to control the non-linear function in order that the musical tone synthesized by the circuit shown in FIG. 4 becomes full of variety in the tone color or expression thereof. The foregoing unit shown in FIG. 6 is designed to impart the hysteresis characteristic to the non-linear function and control the width of hysteresis loop and non-linear function curve by the performance information. In addition to such functions of the foregoing unit shown in FIG. 6, this unit shown in FIG. 9 further provides functions of controlling the height, inclination and size of non-linear function curve or hysteresis transition level in response to the control variables inputted thereto by operating the keyboard and the like.

Herein, the width of hysteresis loop represents the level difference between the threshold values t1m1, t0m1 or threshold values t0p1, t1p1. Such width of hysteresis loop can be changed by rewriting the coefficients t1m1, t0m1, t0p1, t1p1 in the units shown in FIGS. 6, 9. This width of hysteresis loop depends on the bowing pressure Fb. Preferably, it is effective to enlarge the width of hysteresis loop as the bowing pressure Fb becomes large.

The hysteresis transition level represents the absolute value of the threshold values t1m1, t0m1, t0p1, t1p1 as shown in FIG. 5. This hysteresis transition level can be controlled as similar to the above-mentioned control of the width of hysteresis loop.

As comparing to the foregoing unit shown in FIG. 6, this unit shown in FIG. 9 further provides a control circuit 160 and multipliers 161, 162. Herein, the control circuit 160 supplies coefficients corresponding to the performance data to the multipliers 161, 162 respectively.

In both of the units shown in FIGS. 6, 9, the non-linear function shown in FIG. 5 is made from two functions shown in FIGS. 7, 8. As described before, when the input data becomes lower than t1m1 or becomes higher than t1p1 while the unit refers to the hyperbolic function, such hyperbolic function is changed over to the linear function. On the other hand, when the input data becomes higher than t0m1 or become lower than t0p1 while the unit refers to the linear function, such linear function is changed over to the hyperbolic function. The above-mentioned hysteresis characteristic of the non-linear function is achieved by using two function tables, one of which is selectively employed based on the comparison result to be obtained by comparing the input data to certain threshold value. The certain threshold value can be set as the predetermined value, or it can be varied in response to the control parameter.

The foregoing unit shown in FIG. 6 provides four constant data t0p1, t1p1, t1m1, t0m1 in advance. These constant data are multiplied by the bowing pressure Fb, and then the multiplication results are used as the threshold values. The addition, the delay circuit 124 functions to store the data indicative of the function table which is precedingly used. Based on the output of delay circuit 124, the input data is compared to the threshold values t0p1, t0m1 or threshold values t1p1, t1m1, so that the unit will refer to desirable one of two function tables. Thus, it is possible to embody the non-linear function having the hysteresis characteristic as shown in FIG. 5.

If the height and inclination of non-linear function curve, size of hysteresis loop and hysteresis transition level are further varied in the non-linear function generating unit 107 shown in FIG. 4, it is possible to vary the response, tone color and tone-generation manner of the synthesized musical tone. Therefore, the variation of the parameters to be made by operating the performance switches and controls according to needs is effective when improving the variety of the tone color and expression of the musical tone.

Incidentially, the height of non-linear function curve corresponds to the asymptotic line of the hyperbolic curve with respect to the horizontal axis of FIG. 8. This height of non-linear function curve can be controlled by controlling the coefficient of the multiplier 113 or 161.

In addition, the inclination of non-linear function curve represents the inclination of the linear curve shown in FIG. 7. Such inclination can be controlled by controlling the coefficient of the multiplier 162 shown in FIG. 9.

(3) Modified Examples of Second Embodiment

The second embodiment as described above can be modified as follows.

In the second embodiment, the threshold values of the hysteresis loop are fixed at the outputs of multipliers 114 to 117. However, it is possible to set such threshold values as the variables which are controlled by the performance information. In this case, the variation of tone color can be enlarged, so that it is possible to further improve the musical expression. For example, by varying the width of hysteresis loop (i.e., difference between the threshold values t0m1, t1m1 or threshold values t0p1, t1p1) in response to the bowing pressure Fb, it is possible to vary the tone color in response to the pressure Fb. In this case, the width of hysteresis loop is enlarged with respect to the relatively high bowing pressure, while it is reduced with respect to the relatively low bowing pressure.

The multiplier 113 shown in FIGS. 6, 9 is designed to multiply the output of function 111 by the bowing pressure Fb, therefore, the jump width to be occurred when changing over the function non-linearly is varied due to such multiplication. Instead of Fb, it is possible to use bowing pressure function, by which the musical expression can be improved by varying the bowing pressure. Further, instead of the bowing pressure, it is possible to use other performance parameters such as the bowing velocity and the like.

In addition, it is effective to vary the threshold value in accordance with the musical interval or thickness of the string. In the case where the sound other than the sound of string bowing instrument is to be synthesized, it is possible to reverse the hysteresis transition manner of the non-linear function.

The second embodiment is designed to generate the non-linear function having the hysteresis characteristic, in which the height and width of hysteresis loop and hysteresis transition level are controlled. However, the present invention is not limited to such second embodiment. Therefore, it is possible to generate the non-linear function which does not have the hysteresis characteristic. In this casr, the (hysteresis) transition level can be controlled as described before.

Further, the second embodiment is designed to synthesize the sound of string bowing instrument. However, it is possible to modify the second embodiment such that the sound of wind instrument or artificial sound can be synthesized. Even when the sound of wind instrument is to be synthesized, the height, inclination and size of hysteresis loop and hysteresis transition level can be also controlled as similar to the synthesis of the sound of string bowing instrument.

Lastly, this invention may be practiced or embodied in still other ways without departing from the spirit or essential character thereof as described heretofore. Therefore, the preferred embodiments described herein are illustrative and not restrictive, the scope of the invention being indicated by the appended claims and all variations which come within the meaning of claims are intended to be embraced therein.

What is claimed is:

1. A musical tone signal forming apparatus comprising:

(a) a loop in which a signal is repeatedly circulating;

(b) first and second delay means provided within said loop, each delaying a signal supplied thereto;

(c) mixing means for mixing a start control signal from an external device with each of outputs of said first and second delay means to thereby produce a mixed signa;

(d) non-linear conversion means for effecting a non-linear conversion on said mixed signal to thereby produce a converted signal, which is outputted to each of said first and second delay means, and (e) modification means for providing a modification control signal corresponding to preformance information from an external device and preforming a calculation operation between the modification control signal and at least one of said mixed signal and said converted signal and providing the calculation results to at least one of the conversion means and delay means, respectively, wherein a synthesized musical tone signal is picked up from said loop.

2. A musical tone signal forming apparatus according to claim 1 wherein said non-linear conversion means provides a hysteresis characteristic in its non-linear conversion.

3. A musical tone signal forming apparatus according to claim 1 further providing transmission characteristic varying means at an input of at least one of said first and second delay means, whereby a transmission characteristic of said signal circulating said loop is varied by said transmission characteristic varying means.

4. A musical tone signal forming apparatus according to claim 1 wherein at least one of said first and second delay means is comprised of a variable delay circuit having a variable delay time, said apparatus further comprising musical tone control means for controlling the variable delay time to be applied to said signal by said variable delay circuit in response to a frequency of a musical tone to be generated.

5. A musical tone signal forming apparatus according to claim 1 wherein said non-linear conversion means is comprised of a variable non-linear conversion circuit having a variable non-linear conversion characteristic, said apparatus further including musical tone control means for controlling the variable non-linear conversion characteristic.

6. A musical tone signal forming apparatus according to claim 5 wherein said variable non-linear conversion circuit includes a non-linear conversion table for storing non-linear conversion characteristic and characteristic varying means for varying the non-linear conversion characteristic of said non-linear conversion table in response to a predetermined musical parameter.

7. A muscial tone signal forming apparatus comprising:

(a) a closed-loop including delay means which delay a signal circulating therein;

(b) non-linear function means for receiving a performance operation signal and said signal picked up from said closed-loop and generating an output signal in accordance with a non-linear function, said output signal being fed back to said closed-loop, wherein said non-linear function has a hysteresis characteristic which is controlled by said performance operation signal; and means for providing a signal from the closed loop as a musical tone signal.

8. A musical tone signal forming apparatus comprising:

(a) a closed-loop including delay means which delay a signal circulating therein;

(b) non-linear function means for receiving a performance operation signal and said signal picked up from said closed-loop and generating an output signal in accordance with a non-linear function, said output signal being fed back to said closed-loop;

(c) control means for generating a control signal corresponding to a musical tone parameter, wherein said non-linear function means has a hysteresis characteristic and wherein the hysteresis characteristic is controlled by said control signal; and means for providing a signal from the closed loop as a musical tone signal.

9. A musical tone signal forming apparatus according to claim 7 or 8, wherein said non-linear function means comprises a table from which an output signal is read in response to said performance signal and said signal picked up from the closed loop.

* * * * *